United States Patent [19]

Ruger

[11] 3,984,933

[45] Oct. 12, 1976

[54] EJECTOR ARRANGEMENT FOR BREAK-OPEN FIREARM

[75] Inventor: William B. Ruger, Southport, Conn.

[73] Assignee: Sturm, Ruger & Co. Inc., Southport, Conn.

[22] Filed: Aug. 1, 1975

[21] Appl. No.: 601,100

[52] U.S. Cl. ..... 42/47
[51] Int. Cl.[2] ..... F41C 15/06
[58] Field of Search ..... 42/46, 47, 48

[56] References Cited

UNITED STATES PATENTS

| | | | |
|---|---|---|---|
| 2,952,933 | 9/1960 | Stevens | 42/46 |
| 3,142,125 | 7/1964 | Groover | 42/47 |
| 3,710,494 | 1/1973 | Hyytinen | 42/47 |
| 3,715,825 | 2/1973 | Ilmonen | 42/47 |

*Primary Examiner*—Charles T. Jordan
*Attorney, Agent, or Firm*—Pennie & Edmonds

[57] ABSTRACT

Break-open firearms of the type to which the present invention relates have a frame, a barrel housing pivotally mounted on the frame, at least one barrel secured to the barrel housing and an ejector slidably mounted for longitudinal movement in an ejector receiving slot formed in the barrel housing. The present invention comprises an improvement in the means for retaining the ejector in the ejector receiving slot of the barrel housing. An integrally formed vertically extending ejector retainer lug is disposed adjacent the forward end of the ejector and an ejector retainer lug receiving recess is formed in the barrel housing adjacent the forward end of the ejector receiving slot, the ejector retainer lug of the ejector being received in the retainer lug receiving recess of the barrel housing when the ejector is at its rearward position and being moved forwardly out of said recess when the ejector is at its forward position. An ejector spring and an ejector push rod are mounted on one side of the barrel housing and a push rod receiving recess is formed in the ejector adjacent the rearward end thereof, the ejector push rod being received in the push rod receiving recess of the ejector and the ejector spring urging the ejector push rod and the ejector rearwardly.

11 Claims, 8 Drawing Figures

EJECTOR ARRANGEMENT FOR BREAK-OPEN FIREARM

BACKGROUND OF THE INVENTION

1. Field of the Invention

THis invention relates to break-open firearms having one or more barrels and having ejectors for ejecting spent cartridges from the barrels when the barrels are moved from their closed position to their open position.

2. Prior Art

Broadly, the term "break-open firearm" includes all firearms that have one or more barrels pivotally mounted on the frame or receiver of the firearm, the barrel or barrels being rotatable from their closed and locked ready-to-fire position to their open loading-and-unloading position, and return, as required by the shooter. Such firearms are normally designed so that they can be disassembled into two or more parts or sub-assemblies (for example, a barrel sub-assembly and a stock sub-assembly) for convenience in cleaning, storing and transporting the firearm, and they include single and double barreled rifles and shotguns and combinations thereof (including both side-by-side and over-and-under type).

In break-open firearms of the type to which the present invention relates the barrel or barrels are mounted on a barrel housing (also known as a monoblock) that is pivotally mounted on the frame of the firearm, the barrel housing being formed with one or more longitudinally extending barrel receiving bores in which the rearward ends of the barrels are received and to which they are secured. The barrel housing is also formed with one or more longitudinally extending ejector receiving slots in each of which is mounted a longitudinally movable ejector adapted to eject a spent cartridge from one of the barrels when the barrels and barrel housing are rotated from their closed position to their open loading-and-unloading position. One of the sub-assemblies into which the firearm can be dis-assembled comprises the stock, frame and firing mechanism of the firearm, and another of the sub-assemblies comprises the barrels, barrel housing and ejectors of the firearm. As noted, the ejectors are movably received in longitudinal slots formed in the sides of the barrel received in longitudinal slots formed in the sides of the barrel housing and therefore are completely exposed when the barrel and barrel housing sub-assembly is separated from the stock and frame sub-assembly. As a result, it is necessary to provide means for retaining the ejectors in the ejector receiving slots of the barrel housing in order to prevent the loss of the ejectors when the two sub-assemblies are separated.

Heretofore the means most commonly employed to retain the ejectors in the ejector receiving slots of the barrel housing has been to provide the ejectors and ejector receiving slots with matching dovetail-shaped transverse cross-sections. However, a close and smoothly functioning fit of all moving or mating parts is an extremely important feature of reliable high quality firearms. It is difficult, exacting and time consuming to obtain the close fit and smooth functioning required of the matching dovetail surfaces of the ejectors and ejector receiving slots of conventional break-open firearms. By way of example, in order to minimize lateral play of the dovetailed ejector within the dovetailed ejector receiving slots, it is necessary to fit the facing dovetailed surfaces of these parts together with a clearance of about 0.0005 inch. As a result, considerable effort has heretofore been expended in an attempt to devise other means for retaining ejectors in the ejector receiving slots of the barrel housing that would be less difficult to fabricate to the required smooth fit and small tolerances than are the conventional dovetailed parts.

After an intensive investigation into the aforementioned and related problems encountered in retaining the ejectors in the ejector receiving slots of the barrel housing, I have now devised a new and improved means for retaining the ejectors in the ejector receiving slots which provides the required close fit and smooth functioning of these parts while avoiding the difficulties encountered in the fabrication and fitting of the dovetailed surfaces heretofore employed.

SUMMARY OF THE INVENTION

Break-open firearms of the type to which the present invention relates have a frame and a barrel housing pivotally mounted on the frame. The barrel housing is formed with at least one barrel receiving bore and with at least one ejector receiving slot. A barrel is received in and is secured to each of the barrel receiving bores of the barrel housing, the barrel and barrel housing being rotatable on the frame from their closed postion to their open position and return. An ejector is slidably mounted in each of the ejector receiving slots of the barrel housing for longitudinal movement from its forward position to its rearward shell ejecting position and return, and means are provided for moving the ejector rearwardly when the barrel and barrel housing are moved from their closed position to their open position.

My improvement in means for retaining the ejector in the ejector receiving slot of the barrel housing comprises an integrally formed vertically extending ejector retainer lug disposed adjacent the forward end of the ejector, and an ejector retainer lug receiving recess formed in the barrel housing adjacent the forward end of the ejector receiving slot formed therein, the ejector retainer lug of th ejector being received in the retainer lug receiving recess of the barrel housing when the ejector is at its rearward position and being moved forwardly out of said recess when the ejector is at its forward position. An ejector push rod is mounted for longitudinal movement on the barrel housing, an ejector push rod spring urges the ejector push rod to its rearward position, and a push rod receiving recess is formed in the ejector adjacent the rearward end thereof directly rearward of and in alignment with the rearward end of the ejector push rod, the rearward end of the ejector push rod being received in the push rod receiving recess of the ejector. The forward end of the ejector is releasably retained in the ejector receiving slot of the barrel housing by the ejector retainer lug receiving recess of the barrel housing and the rearward end of the ejector is retained in the ejector receiving slot by the ejector push rod.

More specifically, the barrel housing is advantageously formed with a push rod receiving bore positioned directly rearward of and in alignment with the ejector push rod, the ejector push rod extending through the push rod receiving bore of the barrel housing and being received in the push rod receiving recess of the ejector so that the rearward end of the ejector is releasably retained in the ejector receiving slot of the barrel housing by the ejector push rod and the push rod receiving bore of the barrel housing. The ejector is advantageously provided with a shell ejecting portion adapted to underlie the rim of a cartridge received in the barrel and to move the cartridge rearwardly partially out of the barrel when the ejector is moved rearwardly to its shell ejecting position, a forward facing surface of the shell ejecting portion of the ejector being formed with the said push rod receiving recess of the ejector. In addition, both the ejector receiving slot formed in the barrel housing and the ejector received therein advantageously have matching rectangular transverse cross sections.

BRIEF DESCRIPTION OF THE DRAWINGS

The improvement in ejectors for break-open type firearms will be better understood from the following description in conjunction with the accompanying drawings of which.

DESCRIPTION OF THE PREFERRED EMBODIMENT

Figure 1:
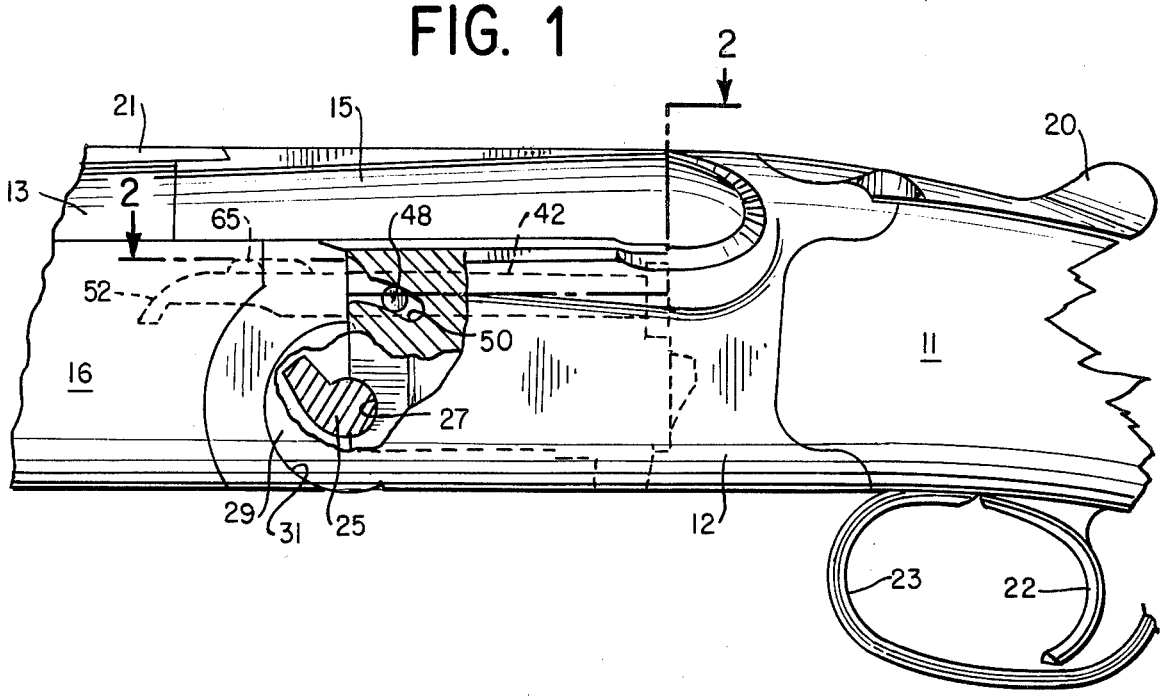
FIG. 1 is a fragmentary side elevation of an over-and-under shotgun embodying the improvement in ejector retaining means of the invention, the left hand side wall of the frame being partially broken away to show the left hand pivot lug and ejector cam slot of the frame.

As previously mentioned, the present invention relates to break-open firearms of the type in which the barrel or barrels of the firearm are mounted on a barrel housing that is pivotally secured to the frame of the firearm, the barrel and barrel housing being rotatable from their closed ready-to-fire position to their open loading-and-unloading position and return. One or more ejectors being mounted for longitudinal movement in ejector receiving slots formed in the sides of the barrel housing, each of the ejectors being adapted to eject a spent cartridge case from the barrel with which the ejector is associated when the barrels and barrel housing are moved from their closed to their open position. The improved ejector retaining means of the invention will be described in conjunction with the over-and-under shotgun shown in the drawings but is not limited to this particular firearm.

Figure 3:
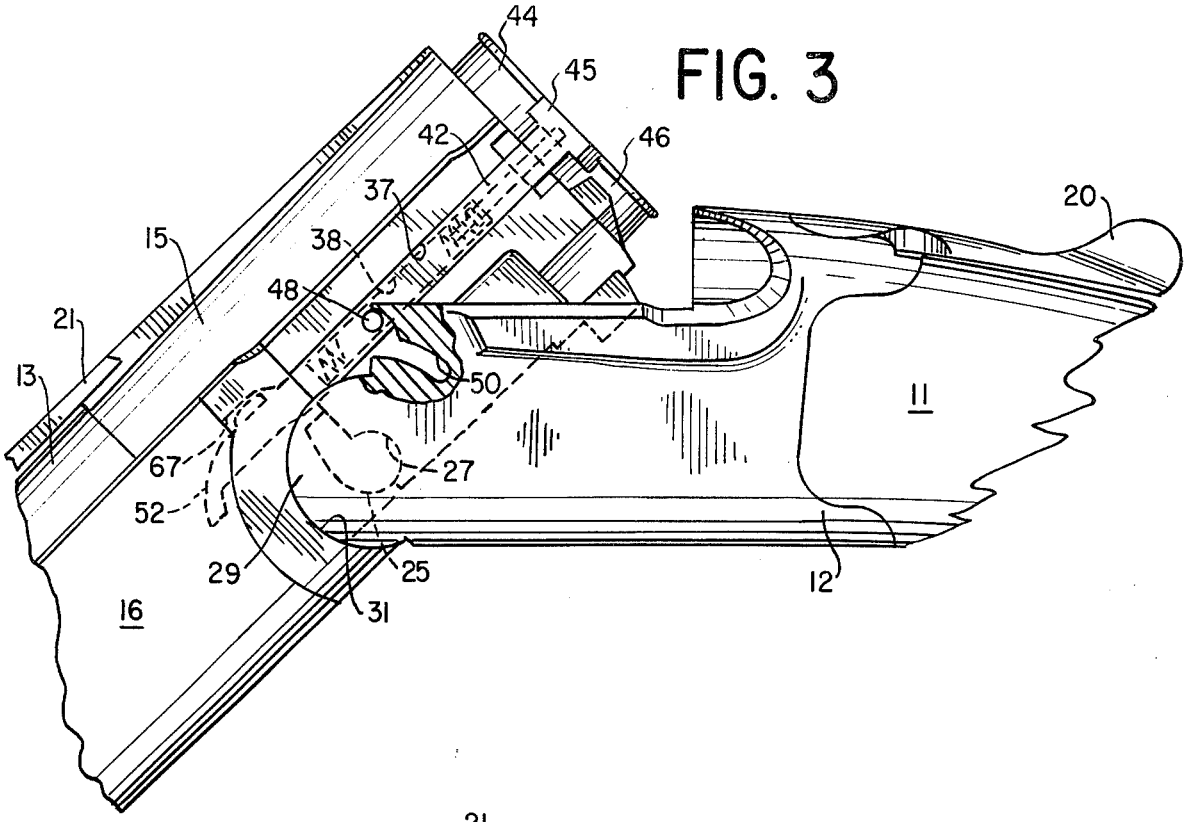
FIG. 3 is a side elevation similar to FIG. 1 showing the barrels of the over-and-under shotgun at their open position.

As shown best in FIGS. 1 and 3 of the drawing, the over-and-under shotgun embodying the invention has a stock 11, a frame 12 mounted on the stock, an upper barrel 13, a lower barrel 14, a monoblock or barrel housing 15 and a forearm stock 16. The barrel housing 15 is formed with an upper barrel receiving bore 18 and with a lower barrel receiving bore 19 (shown best in FIG. 6) in which the rearward ends of the upper barrel 13 and the lower barrel 14 are received and to which they are secured. The forearm stock 16 is releasably secured to the underside of the lower barrel 14 by a forearm latch (not shown), the barrel housing 15 and forearm stock 16 being pivotally mounted on the frame 12 so that the barrels can be rotated from their closed positions as shown in FIG. 1 to their open position as shown in FIG. 3. A top lever 20 is pivotally mounted on the frame for rotation from its barrel locking position to its barrel unlocking position, and a ventilated sight rib 21 is secured to the barrel housing 15 and extends from the barrel housing to the upper end of the barrel 13. Also mounted on the frame 12 are the trigger 22, the trigger guard 23 and the other part of the firing mechanism (not shown).

In common with most other shotguns of this type, the shotgun shown in the drawings is designed to be disassembled into three component sub-assemblies for convenience in cleaning, storing and transporting the shotgun. The three sub-assemblies are the stock sub-assembly (comprising the stock 11, frame 12, top lever 20, etc.), the barrel sub-assembly (comprising the barrels 13 and 14, the barrel housing 15, etc.) and the forearm sub-assembly (comprising the forearm stock 16, the forearm latch, etc.). The inner surfaces of the right hand and left hand side walls of the frame 12 are integrally formed with inner pivot lugs 25 (the left hand pivot lug 25 being shown in section in FIG. 1 of the drawing), and the right and left hand sides of the barrel housing 15 are formed with semi-circular inner pivot bearing recesses 27 adapted to receive the rearward facing portions of the inner pivot lugs 25 (as shown best in FIG. 1). In addition, the forward ends of the right hand and the left hand side walls of the frame 12 are formed with outer pivot portions 29, and the right and left hand sides of the forearm stock 16 are formed with semi-circular outer pivot bearing recesses 31 adapted to receive the forward facing surfaces of the outer pivot portions 29 of the frame 12 (as also shown best in FIG. 1.). When the three sub-assemblies of the shotgun are assembled together as shown in FIGS. 1 and 3, the inner pivot lugs 25 of the frame 12 are received in the pivot bearing recesses 27 of the barrel housing 15 and the outer pivot portions 29 of the frame 12 are received in the outer stock bearing recesses 31 of the forearm stock 16, the forearm stock being secured to the lower barrel 14 by means of the forearm latch. The shotgun is dis-assembled into its three component sub-assemblies by unlatching and removing the forearm stock 16 whereupon the barrel sub-assembly can be readily separated from the stock sub-assembly in the manner known in the art.

The right hand side of the barrel housing 15 is formed with a longitudinally extending right hand ejector receiving slot 33, with a right hand ejector spring receiving recess 34 disposed adjacent the right hand ejector receiving slot 33 and with a right hand ejector push rod receiving bore 35 positioned directly rearward of and in alignment with the right hand ejector spring receiving recess 34. Similarly, a longitudinally extending left hand ejector receiving slot 37 is formed in the left hand side of the barrel housing 15, a left hand ejector spring receiving recess 38 is disposed adjacent the left hand ejector receiving slot 37 and a left hand ejector push rod receiving bore 39 is positioned directly rearward of and in alignment with the left hand ejector spring receiving recess 38.

A right hand ejector 41 is removably mounted in the right hand ejector receiving slot 33 for longitudinal movement in this slot, and a left hand ejector 42 is removably mounted in the left hand ejector receiving slot 37 for longitudinal movement within this slot. The right hand ejector 41 is provided with an inwardly and upwardly extending lateral shell ejecting portion 43 adapted to underlie the rim of a cartridge 44 received in the upper barrel 13 of the shotgun, and the left hand ejector 42 is provided with an inwardly and downwardly extending lateral shell ejecting portion 45 adapted to underlie the rim of a cartridge 46 received in the lower barrel 14 of the shotgun. Each of the ejectors 41 and 42 have a laterally extending ejector cam lug 47 and 48 adapted to be received in the ejector cam slots 49 and 50 formed in the inner surfaces of the right hand and left hand side walls respectively, of the barrel housing 15, and both ejectors have ejector latch portions 51 and 52 at their forward ends that are adapted to be engaged by right hand and left hand ejector latches as hereinafter described.

A right hand ejector spring 54 and ejector spring guide 55 are received in the right hand ejector spring receiving recess 34, and a right hand ejector push rod 56 is received in the right hand ejector push rod receiving bore 35 of the barrel housing 15, the forward end of the push rod 56 being contacted by the ejector spring guide 55 and the rearward end of the push rod 56 being received in the push rod receiving recess 57 formed in the forward facing surface of the shell ejecting portion 43 of the right hand ejector 41. Similarly, a left hand ejector spring 59 and ejector spring guide 60 are received in the left hand ejector spring receiving recess 38, and a left hand ejector push rod 61 is received in the left hand ejector push rod receiving bore 39, the forward end of the push rod 61 being contacted by the ejector spring guide 60 and the rearward end of the push rod 61 being received in the push rod receiving recess 62 formed in the forward facing surface of the shell ejecting portion 45 of the left hand ejector 42.

In normal use the ejector mechanism operates as follows:

Live cartridges or shotgun shells are loaded into the upper and lower barrels 13 and 14 of the shotgun and the barrels are rotated to their closed and ready-to-fire position as shown in FIG. 1. The shooter may fire either one or both of the barrels at his option. When the trigger 22 is pulled, one of the barrels (say, the upper barrel 13) is fired. If the trigger 22 is pulled again the other barrel (say, the lower barrel 14) is fired. The barrels, each containg a fired or spent cartridge, are then unlocked and rotated to their open loading-and-unloading position as shwon in FIG. 3. During the first portion of the travel of the barrels to their open position the right hand and left hand ejector cam lugs 47 and 48 travel forwardly in the arcuate portions of the right hand and left hand ejector cam slots 49 and 50, respectively, and as a result the right hand and left hand ejectors 41 and 42 are maintained by the ejector cam slots at their forward non-ejecting positions. During the last portion of the travel of the barrels to their open position the ejector cam lugs 47 and 48 enter the enlarged portions at the forward ends of the ejector cam slots 49 and 50, thereby allowing the ejector springs 54 and 59 to move the ejectors 41 and 42 to their rearward shell ejecting positions as shown in FIG. 3. When the ejector cam lugs 47 and 48 enter the enlarged portions of the ejector cam slots 49 and 50, the ejectors 41 and 42 normally snap rearwardly with sufficient force to throw the spent cartridge 44 and 46 clear of the chambers of the barrels of the shotgun.

If only one barrel is fired, the ejector mechanism for that barrel will throw the spent cartridge clear of the chamber of that barrel, the ejector mechanism for the other barrel remaining at its forward non-ejecting position even when the barrels are fully open as shown in FIG. 3. This is accomplished by an ejector latch mechanism associated with the ejectors of each barrel which engages the ejector latch portions 51 and 52 of the ejectors 41 and 42 when the firing mechanism (that is, the hammer and related parts) for each barrel is at its cocked and ready-to-fire position. If one of the barrels is fired the ejector latch mechanism associated with the ejector for that barrel releases the ejector latch portion of that ejector thereby allowing the ejector to eject the spent cartridge as hereinbefore described. If both barrels are fired the ejector latch mechanisms associated therewith will release both ejectors to permit ejection of the spent cartridges from both barrels. This mechanism in one form or another is common to all high quality over-and-under firearms and will not be further considered herein. When the barrels are rotated from their open position as shown in FIG. 3 their closed position as shown in FIG. 1, the cam surfaces of the ejector cam slots 49 and 50 in which the ejector cam lugs 47 and and 48 are received cause the ejectors 41 and 42 to more forwardly from their ejecting to their non-ejecting positions.

Figure 4:
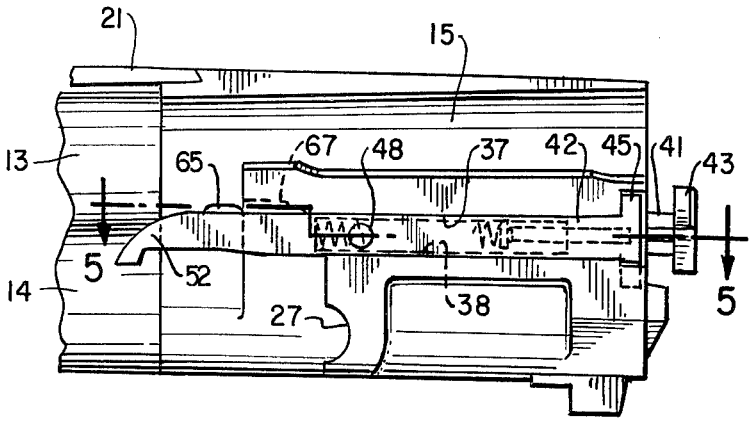
FIG. 4 is a side elevation of the barrel housing showing the right hand ejector at its rearward position and the left hand ejector at its forward position.

When the shotgun is disassembled into its three component sub-assemblies (namely, the aforementioned stock sub-assembly, barrel sub-assembly and forearm sub-assembly), the ejectors 41 and 42 are removed with the barrel sub-assembly as a part thereof as shown best in FIG. 4. To prevent loss of the ejectors when the barrel sub-assembly is separated from the stock sub-assembly of the shotgun, means are provided for retaining the ejectors 41 and 42 in the ejector receiving slots 33 and 37 of the barrel housing 15.

Figure 2:
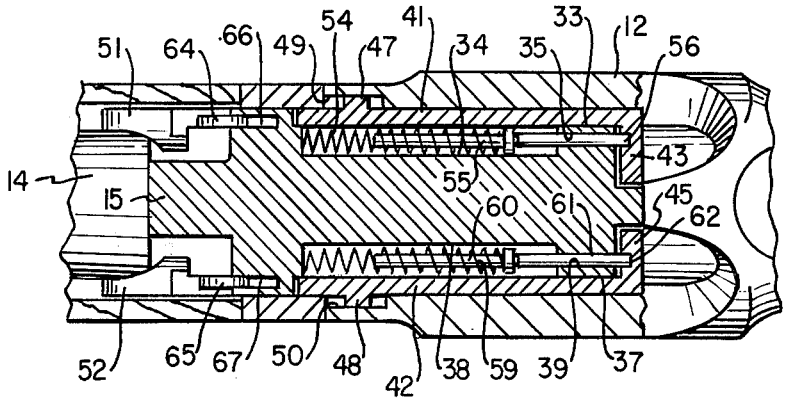
FIG. 2 is a sectional view along lines 2—2 of FIG. 1.
Figure 8:
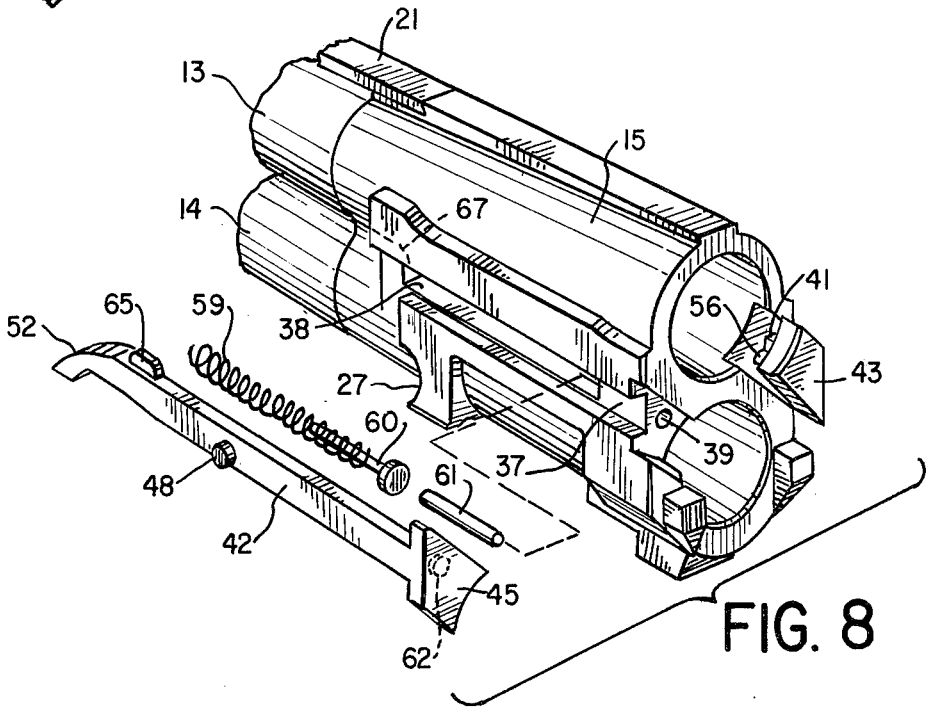
FIG. 8 is a perspective view, partly exploded of the barrel housing and ejectors.
Figure 6:
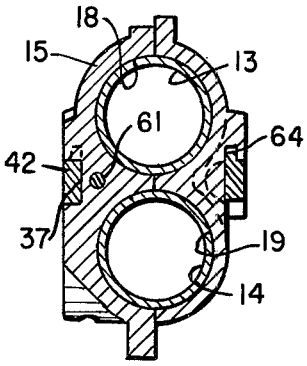
FIG. 6 is a sectional view along line 6—6 of FIG. 5.
Figure 5:
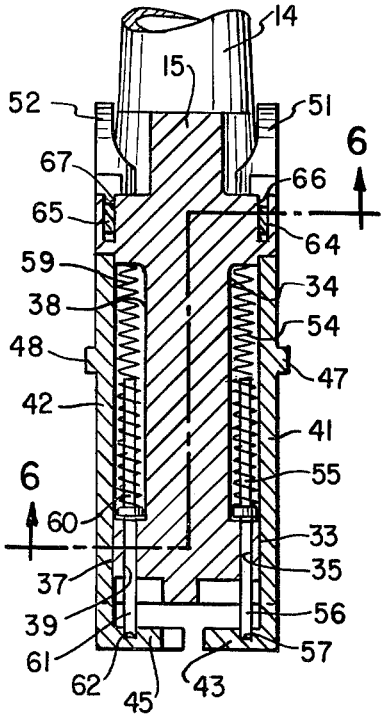
FIG. 5 is a sectional view along line 5—5 of FIG. 4 showing the right hand and left hand ejectors at their rearward positions.
Figure 7:
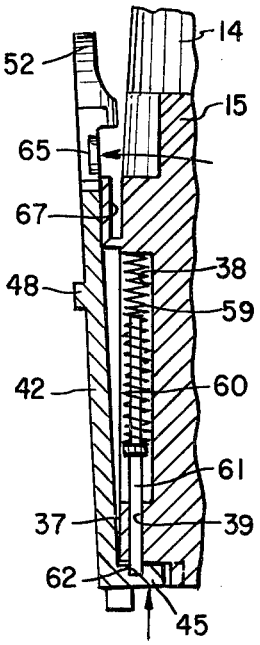
FIG. 7 is a fragmentary sectional view similar to FIG. 5 showing the left hand ejector being removed from the barrel housing.

As shown best in FIGS. 6 and 7, the ejector receiving slots 33 and 37 of the barrel housing 15 and the ejectors 41 and 42 slidably received in the slots 33 and 37 have matching rectangular cross-sections. The rectangular cross-sections of the ejectors and ejector receiving slots readily permit the attainment of the required closed fit and smooth functioning of these parts without the technically difficult and time consuming procedures required when these parts have dovetailed cross-sections as in the prior over-and-under firearms. As shown best in FIGS. 4, 7 and 8, each of the ejectors 41 and 42 is provided with a vertically extending ejector retainer lug 64 and 65, respectively, disposed adjacent the forward ends of the ejectors. A right hand ejector retainer lug receiving recess 66 is formed in the barrel housing 15 adjacent the forward end of the right hand ejector receiving slot 33 formed therein, and a left hand ejector retainer lug receiving recess 67 is formed in the barrel housing adjacent the forward end of the left hand ejector receiving slot 37 formed therein. When the ejectors 41 and 42 are received in the ejector receiving slots 33 and 37, respectively, and when the ejectors are at their rearward positions as shown best in FIGS. 3 and 5 the ejector retaining lugs 64 and 65 of the ejectors are received in the ejector retainer lug receiving recesses 66 and 67, respectively, of the barrel housing. When the ejectors 41 and 42 are at their forward positions as shown best in FIGS. 1, 2 and 7, the ejector retainer lugs 64 and 65 are moved forwardly out of engagement with the ejector retainer lug receiving recesses 66 and 67.

As previously noted, the forward facing surfaces of the shell ejecting portions 43 and 45 of the right hand and left hand ejectors 41 and 42 are formed with ejector push rod receiving recesses 57 and 62 in which the rearward end of the right hand and left hand ejector push rods 56 and 61 are respectively received. Accordingly, when the barrel sub-assembly is separated from the stock sub-assembly as previously described, the ejector springs 54 and 59 move the ejectors 41 and 42 to their rearward positions as shown best in FIG. 5. When the ejectors 41 and 42 are at their rearward positions, the ejectors are retained in the ejector receiving slots 33 and 37 at their forward ends by the ejector retainer lugs 64 and 65 (which are received in the ejector retainer lug receiving recesses 66 and 67, respectively) and are retained in said ejector receiving slots at their rearward ends by the push rods 56 and 61 (which are received in the ejector push rod receiving recesses 57 and 62, respectively).

As shown best in FIG. 7 which depicts the removal of the left hand ejector 42 from the barrel housing 15, the ejectors 41 and 42 are removed from the ejector receiving slots 33 and 37 of the barrel housing 15 by pressing each ejector forwardly against the pressure of its ejector spring to move the ejector retainer lugs 64 and 65 forwardly out of the ejector retainer lug receiving recesses 66 and 67. The forward ends of the ejectors are then moved laterally outwardly from the barrel housing as shown in FIG. 7, whereupon the ejectors can readily be separated from the push rods 56 and 61 and the barrel housing 15.

I claim:

1. In a break-open firearm having a frame; a barrel housing pivotally mounted on the frame, said barrel housing being formed with at least one barrel receiving bore and with at least one ejector receiving slot; a barrel received in and secured to the barrel receiving bore of the barrel housing, said barrel and barrel housing being rotatable on the frame from their closed position to their open position and return; an ejector slidably mounted in the ejector receiving slot of the barrel housing for longitudinal movement from its forward position to its rearward shell ejecting position and return; and means for moving the ejector rearwardly when the barrel and barrel housing are moved from their closed position to their open position; the improvement in means for retaining the ejector in the ejector receiving slot of the barrel housing which comprises:

an integrally formed vertically extending ejector retainer lug disposed adjacent the forward end of the ejector, and an ejector retainer lug receiving recess formed in the barrel housing adjacent the forward end of the ejector receiving slot formed therein, the ejector retainer lug of the ejector being received in the retainer lug receiving recess of the barrel housing when the ejector is at its rearward position and being moved forwardly out of said recess when the ejector is at its forward position; and an ejector push rod mounted for longitudinal movement on the barrel housing, an ejector push rod spring urging the ejector push rod to its rearward position, and a push rod receiving recess formed in the ejector adjacent the rearward end thereof directly rearward of and in alignment with the rearward end of the ejector push rod, the rearward end of the ejector push rod being received in the push rod receiving recess of the ejector;

whereby the ejector is releasably retained in the ejector receiving slot of the barrel housing at its forward end by the ejector retainer lug receiving recess of the barrel housing and at its forward end by the ejector retainer lug receiving recess of the barrel housing and at its rearward end by the ejector push rod.

2. The firearm according to claim 1 in which the barrel housing is formed with a push rod receiving bore positioned directly rearward of and in alignment with the ejector push rod; and in which the ejector push rod extends through the push rod receiving bore of the barrel housing and is received in the push rod receiving recess of the ejector; whereby the ejector is releasably retained in the ejector receiving slot of the barrel housing at its rearward end by the ejector push rod and the push rod receiving bore of the barrel housing.

3. The firearm according to claim 1 in which the ejector is provided with a shell ejecting position adapted to underlie the rim of a cartridge received in the barrel and to move said cartridge rearwardly partially out of the barrel when said ejector is moved rearwardly to its shell ejecting position.

4. The firearm according to claim 3 in which a forward facing surface of the shell ejecting portion of the ejector is formed with the said push rod receiving recess of the ejector.

5. The firearm according to claim 1 in which both the ejector receiving slot formed in the barrel housing and the ejector received therein have matching rectangular transverse cross sections.

6. In a break-open firearm having a frame; a barrel housing pivotally mounted on the frame, said barrel housing being formed with upper and lower barrel receiving bores and with right hand and left hand ejector receiving slots; an upper barrel and a lower barrel received in and secured to the upper and lower barrel receiving bores of the barrel housing, said barrels and barrel housing being rotatable on the frame from their closed position to their open position and return; a right hand ejector slidably mounted in the right hand ejector receiving slot of the barrel housing for longitudinal movement from its forward position to its rearward shell ejecting position and return; a left hand ejector slidably mounted in the left hand ejector receiving slot of the barrel housing for longitudinal movement from its forward position to its rearward shell ejecting position and return; and means for moving the right hand and left hand ejectors rearwardly when the barrels and barrel housing are moved from their closed position to their open position; the improvement in means for retaining the ejectors in the ejector receiving slots of the barrel housing which comprises;

an integrally formed vertically extending ejector retainer lug disposed adjacent the forward end of each ejector, and an ejector retainer lug receiving recess formed in each side of the barrel housing adjacent the forward ends of the right hand and left hand ejector receiving slots formed therein, the ejector retainer lugs of the ejectors being received in the retainer lug receiving recesses of the barrel housing when the ejectors are at their rearward positions and being moved forwardly out of said recesses when the ejectors are at their forward positions; and an ejector push rod mounted for longitudinal movement on each side of the barrel housing, an ejector push rod spring urging each of the ejector push rods to their rearward positions, and a push rod receiving recess formed in each of the ejectors adjacent the rearward ends thereof directly rearward of and in alignment with the rearward ends of each of the ejector push rods, the rearward ends of the ejector push rods being received in the push rod receiving recesses of the ejectors;

whereby the ejectors are releasably retained in the ejector receiving slots of the barrel housing at their forward ends by the ejector retainer lug receiving recesses of the barrel housing and at their rearward ends by the ejector push rods.

7. The firearm according to claim 6 in which the barrel housing is formed with the push rod receiving bores positioned directly rearward of and in alignment with each of the ejector push rods on each side of the barrel housing; and in which the ejector push rods extend through the push rod receiving bores of the barrel housing and are received in the push rods receiving recesses of the ejectors; whereby the ejectors are releasably retained in the ejector receiving slots of the barrel housing at their rearward ends by the ejector push rods and the push rod receiving bores of the barrel housing.

8. The firearm according to claim 6 in which the right hand ejector is provided with a lateral shell ejecting portion adapted to underlie the rim of a cartridge received in one barrel of the firearm and to move said cartridge rearwardly partially out of said barrel when said ejector is moved rearwardly to its shell ejecting position; and in which the left hand ejector is provided with a lateral shell ejecting portion adapted to underlie the rim of a cartridge received in the other barrel of the firearm and to move said cartridge rearwardly partially out of said barrel when said ejector is moved rearwardly to its shell ejecting position.

9. The firearm according to claim 8 in which a forward facing surface of the shell ejecting portion of the right hand ejector and a forward surface of the shell ejecting portion of the left hand ejector are both formed with the said push rod receiving recesses of the said right hand and left hand ejectors.

10. The firearm according to claim 8 in which the shell ejecting portion of the right hand ejector is adapted to underlie the rim of a cartridge received in the upper barrel of the firearm; and in which the shell ejecting portion of the left hand ejector is adapted to underlie the rim of a cartridge received in the lower barrel of the firearm.

11. The firearm according to claim 6 in which both the right hand and left hand ejector receiving slots formed in the barrel housing and the right hand and left hand ejectors received therein have matching rectangular transverse cross sections.

* * * * *